US005274918A

United States Patent [19]

Reed

[11] Patent Number: 5,274,918

[45] Date of Patent: Jan. 4, 1994

[54] METHOD FOR PRODUCING CONTACT SHORTING BAR INSERT FOR MODULAR JACK ASSEMBLY

[75] Inventor: Carl G. Reed, Clemmons, N.C.

[73] Assignee: The Whitaker Corporation, Wilmington, Del.

[21] Appl. No.: 48,097

[22] Filed: Apr. 15, 1993

[51] Int. Cl.[5] ..... H01R 43/04; H01R 43/00

[52] U.S. Cl. ..... 29/882; 29/418; 29/883; 264/263; 264/277; 439/507

[58] Field of Search ..... 29/418, 882, 883; 439/507, 509, 511, 736, 885; 264/263, 273, 277

[56] References Cited

U.S. PATENT DOCUMENTS

| | | | |
|---|---|---|---|
| 4,274,691 | 6/1981 | Abernethy et al. | 439/188 |
| 4,552,423 | 11/1985 | Swengel, Jr. | 439/188 |
| 4,671,599 | 6/1987 | Olsson | 439/188 |
| 4,699,443 | 10/1987 | Goodrich et al. | 439/188 |
| 4,725,241 | 2/1988 | Bertini et al. | 439/188 |
| 4,854,041 | 8/1989 | Saito et al. | 29/883 |
| 4,863,393 | 9/1989 | Ward et al. | 439/188 |
| 4,887,347 | 12/1989 | Hikita | 29/883 |
| 5,123,854 | 6/1992 | Petersen et al. | 439/188 |
| 5,178,563 | 1/1993 | Reed | 439/676 |

*Primary Examiner*—P. W. Echols

*Attorney, Agent, or Firm*—William B. Noll

[57] ABSTRACT

The disclosure is directed to a method of manufacturing a shorting bar insert for placement in a modular jack assembly to provide for the selective shorting of predetermined contacts during periods of nonelectrical engagement, with a modular plug, such as for an 8 position miniature modular jack in accordance with USOC STYLE RJ48X, for example. The method comprises the steps of preparing a strip of stamped contacts from a planar sheet metal blank joined together by a removable carrier strip having a front face and a back face, where the contacts are formed in pairs in parallel relationship and joined together at their ends remote from the carrier strip, the carrier strip including registration means, such as holes, offset from the centerline of each respective pair of contacts. Thereafter, placing a pair of contact containing carrier strips in back-to-back relationship with the registration means aligned, whereby the contacts are realigned in overlapping relationship, and insert molding a dielectric material about the joined ends of the overlapping sets of contacts. Finally, removal of the carrier strips will reveal a modular jack assembly insert having projecting parallel contacts matching the modular jack contact slot spacing.

5 Claims, 5 Drawing Sheets

METHOD FOR PRODUCING CONTACT SHORTING BAR INSERT FOR MODULAR JACK ASSEMBLY

BACKGROUND OF THE INVENTION

This invention is directed to a method for the manufacture of a contact shorting bar insert for placement in a modular jack assembly to provide for the selective shorting of predetermined electrical contacts therewithin, i.e. maintain line continuity when no plug is present in the modular jack assembly. A preferred embodiment thereof is in accordance with USOC STYLE DESIGNATION RJ48X, for an 8 position miniature modular jack, which requires shorting between contacts 1 & 4 and 2 & 5. Means to effect shorting of selected contacts in a modular jack assembly are exemplified by the following references.

U.S. Pat. No. 4,863,393 to Ward et al. teaches the use of a bridging card, inserted within a modular jack housing, to effect selected shorting of predetermined contacts. The card may be a conventional printed circuit board with essentially U-shaped conductors deposited on each major surface thereof, where the ends are aligned with the contacts to be shorted or bridged.

U.S. Pat. No. 4,699,443 to Goodrich et al. includes a pair of cantilevered switch contact spring members which are activated in response to the insertion of a plug into a modular jack housing.

U.S. Pat. No. 4,274,691 to Abernethy et al. is directed to the use of a generally U-shaped metal component that is mounted in the rear wall of the housing with the arms or prongs thereof projecting into the housing cavity into which the plug is inserted.

U.S. Pat. No. 4,552,423 to Swengel, Jr. relates to a programmable shunting strip stamped and formed from sheet metal. The shunting strip comprises a web from which a series of contact fingers stamped to extend transversely of the web substantially in its plane. Selected contact fingers may be bent to extend transversely of the plane of the web for receipt in an electrical connector socket to common selected terminals in the socket.

U.S. Pat. No. 4,725,241 to Bertini et al. teaches a system which includes a make/break switching arrangement with the housing, whereupon the plug, insertable therein, includes a camming member which breaks the shorting circuit between selected contacts within the assembly.

U.S. Pat. No. 5,123,854 to Peterson et al. is directed to a shunting system for a modular jack type connector. The system includes a pair of programmable shunts substantially identically stamped and differently formed from sheet metal material for engagement with the contact portions when the two shunts are mounted in different positions in the housing. Selected different ones of the contact fingers of each shunt are removed so that the remaining contact fingers engage only selected ones of the contact portions.

The present invention provides for a simple, yet unique method of manufacturing a shorting bar insert to satisfy the requirement for the selective shorting of contacts within a modular jack assembly. The unique method according to this invention will become apparent from the description which follows, particularly when read in conjunction with the accompanying drawings.

SUMMARY OF THE INVENTION

In the preferred embodiment of this invention, a method is disclosed for the manufacture of a shorting bar insert for placement into a modular jack assembly to provide for the selective shorting of predetermined contacts during periods of nonelectrical engagement with a modular plug. In accordance with CFR, Title 47, FCC Rules and Regulations, Part 68, STYLE RJ48X, for example, for an 8 position miniature modular jack, provision must be provided for shorting the 1 & 4 and 2 & 5 contacts. The method hereof, which results in a shorting bar insert to effectively meet said specification, includes the steps of (a) preparing a strip of stamped and formed contacts from a planar sheet metal blank joined together by a removable carrier strip having a front face and a back face, where the contacts are formed in pairs in parallel relationship and joined together at their ends remote from the carrier strip, the carrier strip including registration means, such as pilot holes, offset from the centerline of each respective pair of contacts in a specified asymmetrical relationship, (b) placing a pair of contact containing carrier strips in back-to-back relationship with the registration means aligned, whereby the contacts on the two strips align in overlapping relationship, to form a symmetrical set, (c) insert molding a dielectric material about the joined ends of each overlapping set of contacts, and (d) removing the carrier strips to reveal a modular jack assembly insert having projecting parallel contacts matching the modular jack contact slot spacing.

DETAILED DESCRIPTION OF PREFERRED EMBODIMENTS

This invention is directed to a method of manufacturing a shorting bar insert for placement in a modular jack assembly to provide for the selective shorting of predetermined contacts, i.e. maintain line continuity, during periods of nonelectrical engagement with a modular plug.

Typically, a modular jack and plug connector, to which this invention relates include spring beam or cantilevered contacts, anchored in the housing and protruding from a portion of the jack housing into the plug receiving cavity of the jack, the contacts or terminals being separated from each other by molded ribs in the housing jack. The terminals include terminal portions, usually in the form of terminal pins. For instance, the terminal pins may form solder tails for insertion into holes in a printed circuit board. In some instances, the terminal pins or solder tails are arranged in a single row, and in many other instances the terminal pins or solder tails are arranged in two rows.

The cantilevered contacts, as known in the art, extend into the cavity so that the contact arts will be resiliently engaged by respective contacts of a complementary plug when inserted into the cavity. However, when it is necessary for contact arms in the resiled condition, i.e., non-mating of plug to housing, to maintain circuit continuity, an effective shorting bar for each selected pair of contact arms is required.

Figure 1:
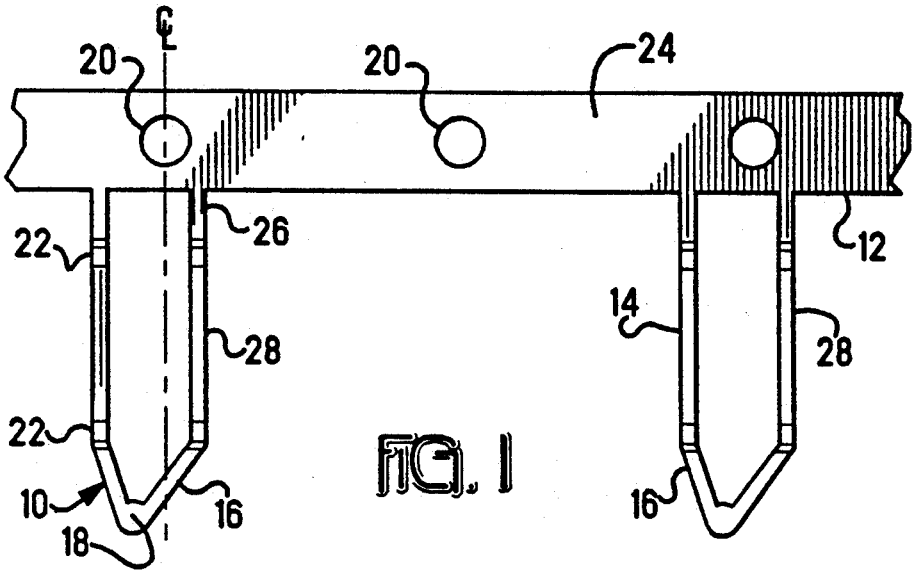
FIG. 1 is a front view of a metal strip of stamped and formed U-shaped, contacts joined together by a common, removable carrier strip, as used in the method of this invention.
Figure 2:
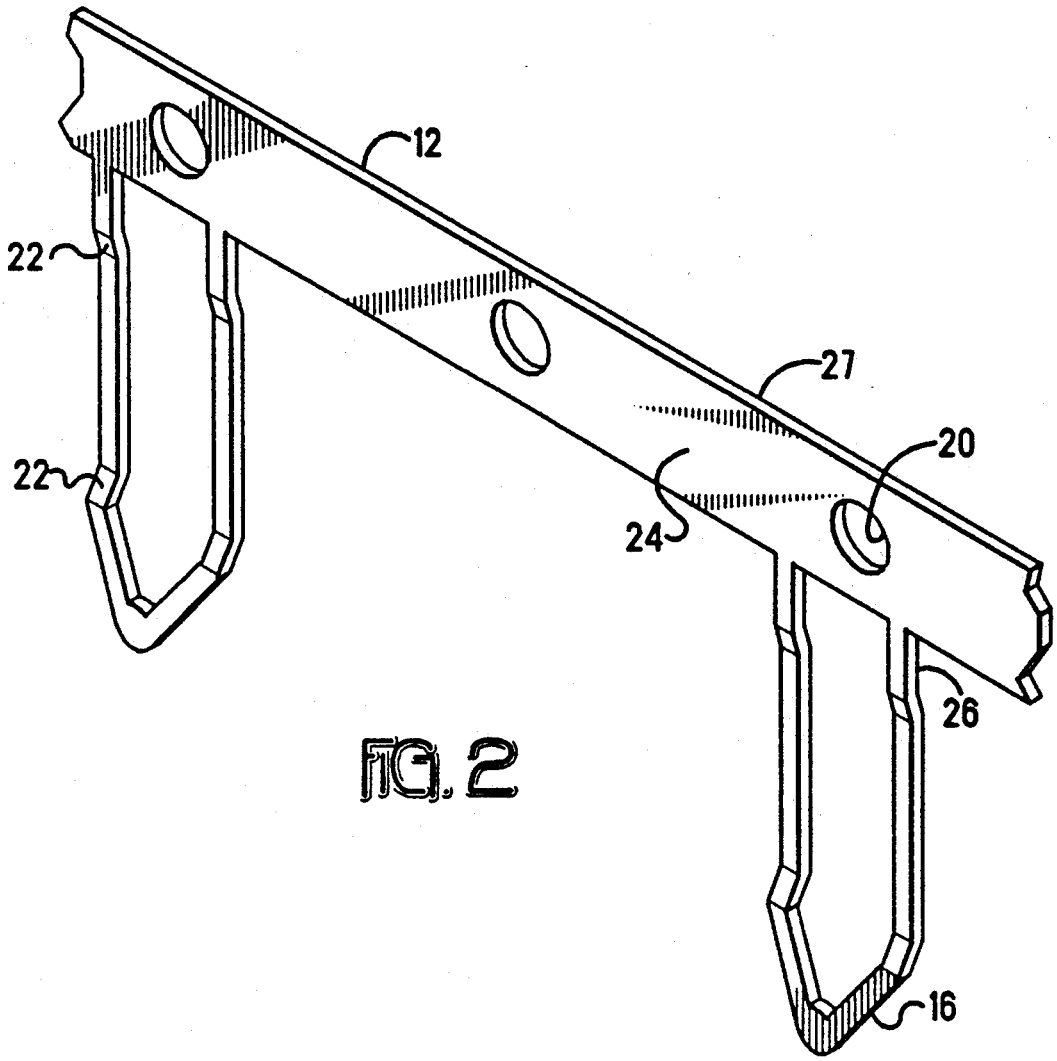
FIG. 2 is a perspective view thereof.

The present invention provides for a method of producing a shorting bar insert in a simple, yet effective manner. Initially, as illustrated in FIGS. 1 and 2, a plurality of stamped and formed U-shaped contacts 10, joined to a common carrier strip 12, are provided. The contacts are characterized by a pair of parallel legs 14 running from the carrier strip 12, to a looped or closed end 16. At the joined end 16, flat surfaces 18 are included, which as hereinafter explained, are positioned between molding pins to maintain contact spacing during the insert molding operation.

The carrier strip 12 is provided with plural registration means 20, preferably in the form of pilot holes, where such registration means are laterally offset from the centerline of the parallel legs 14, see FIG. 1.

The contacts are formed as illustrated in FIG. 2. That is, the central portion of each contact is offset 22 one half material thickness toward the rear face 27 of the carrier strip 12, and the tip or joined end 16 is offset toward the front face 24 to provide crossover clearance. Thus the joined end 16, contact ends 26 and carrier strip 12 lie in a common plane offset from a central portion 22. Thereafter, or in a continuous operation following the stamping and forming, a selected portion 28 of legs 14 may be selectively plated with a conductive material, such as gold, by a plating practice as known in the art.

Figure 3:
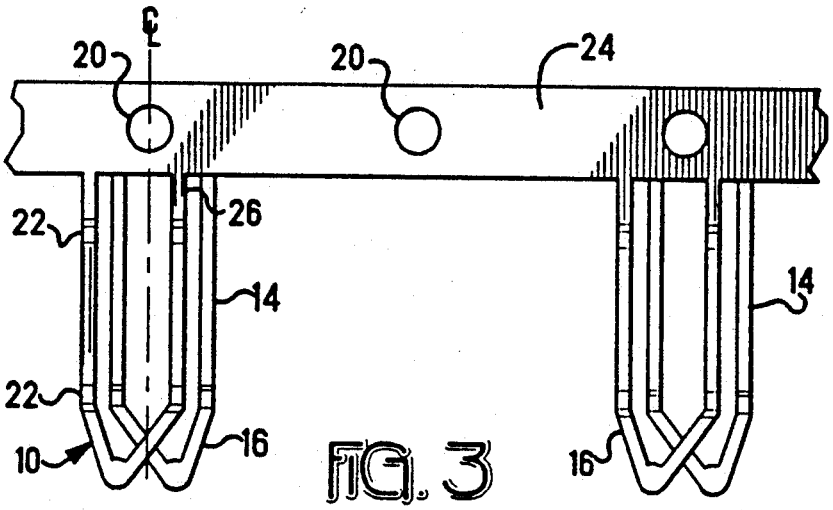
FIG. 3 is a front view of a pair of the metal strips of FIG. 1 arranged in a back-to-back relationship.
Figure 4:
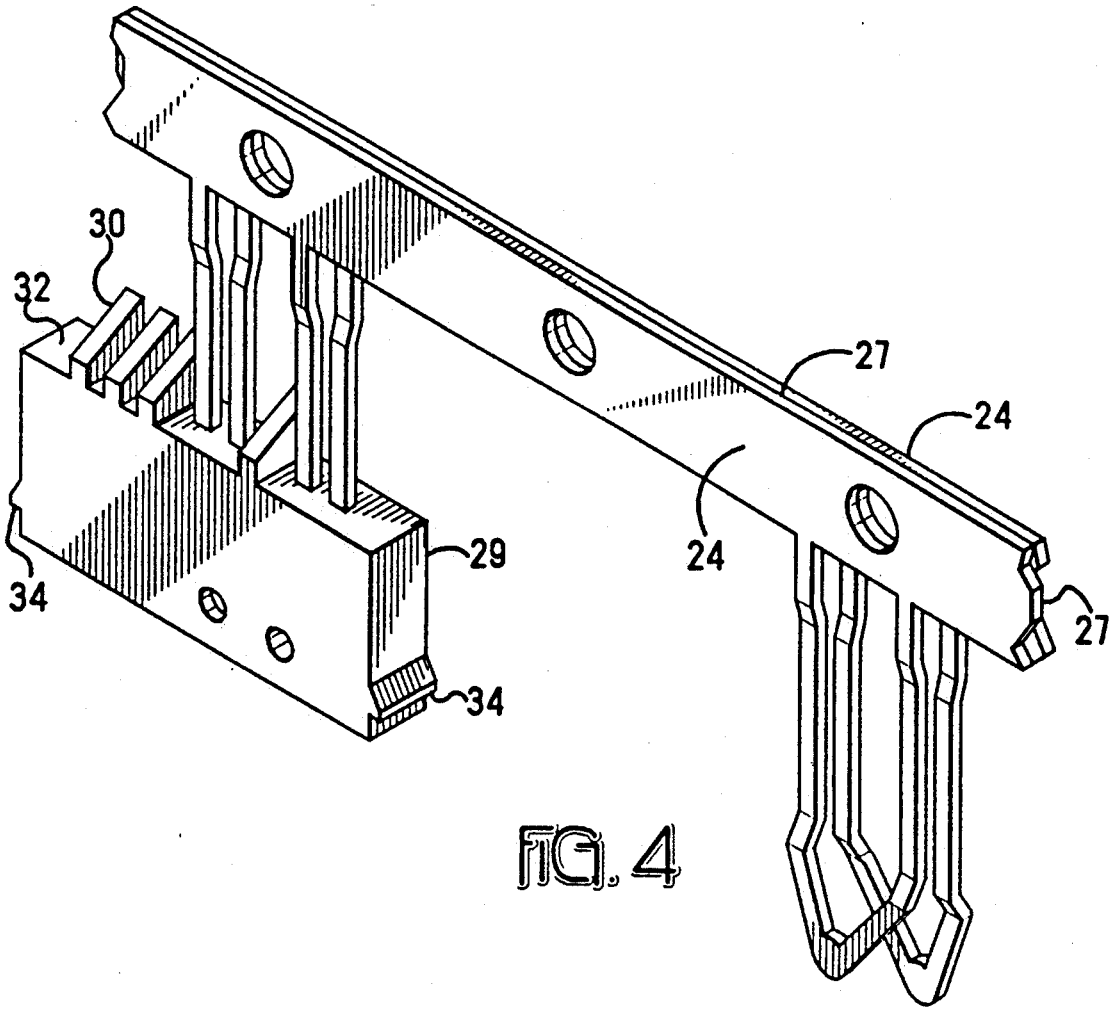
FIG. 4 is a perspective view of a pair of the metal strips, as shown in FIG. 3, further showing the closed ends of the contacts insert molded within a dielectric body.
Figure 5:
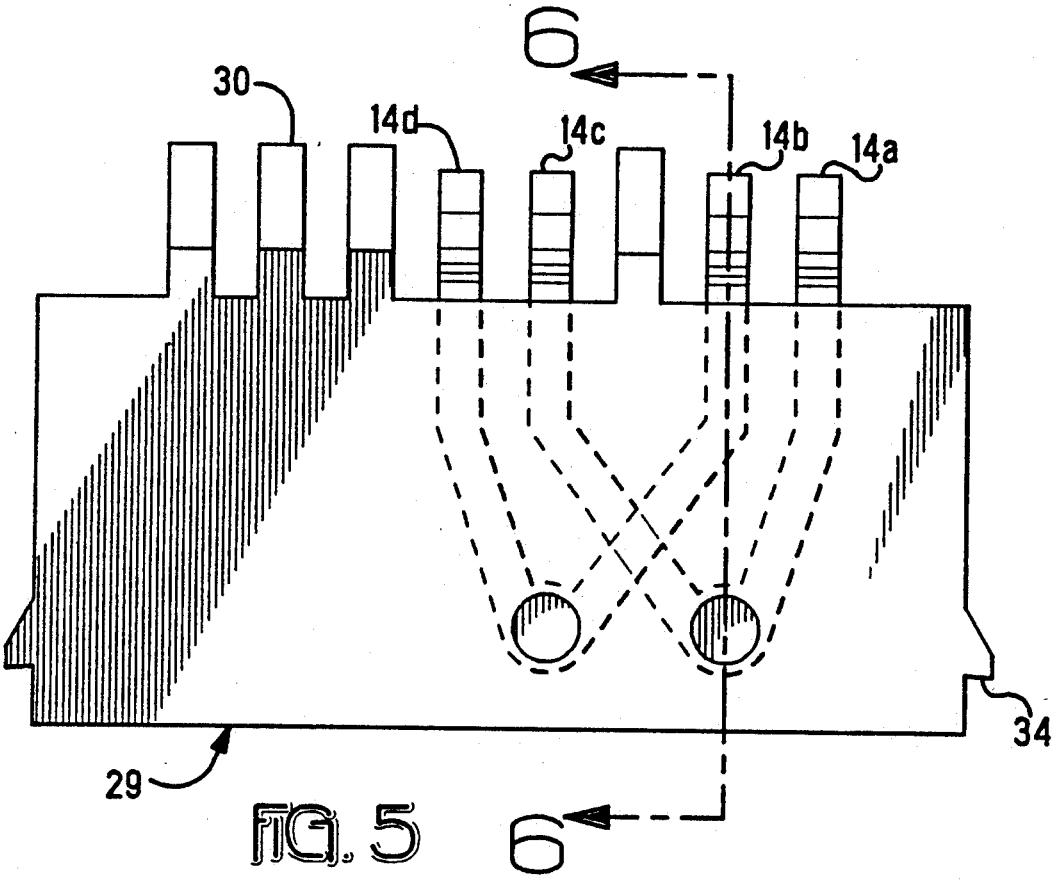
FIG. 5 is a front view of a single shorting bar, with carrier strips removed, as produced by the method hereof.

Two carrier strips, containing the stamped, formed and plated contacts, are arranged in back-to-back relationship, with corresponding registration means 20 aligned. By this arrangement, as best illustrated in FIG. 3, the respective pairs of parallel legs 14 are laterally positioned, and by virtue of the forming are axially spaced, see FIG. 4. In this alignment, with a molding pin tip against each surface 18 to maintain said axial spacing, the contact closed ends 16 are subjected to a molding operation to encase said closed ends 16 to form a modular unity 29 as illustrated in FIGS. 3 and 4. In the latter Figure, it will be noted that the closed ends 16 of the two U-shaped contacts are spaced apart out of electrical contact with one another.

Figure 6:
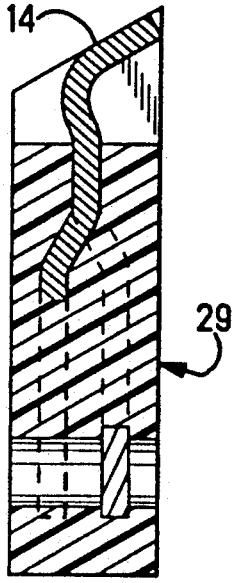
FIG. 6 is a side view of the shorting bar of FIG. 5, taken along line 6—6.
Figure 7:
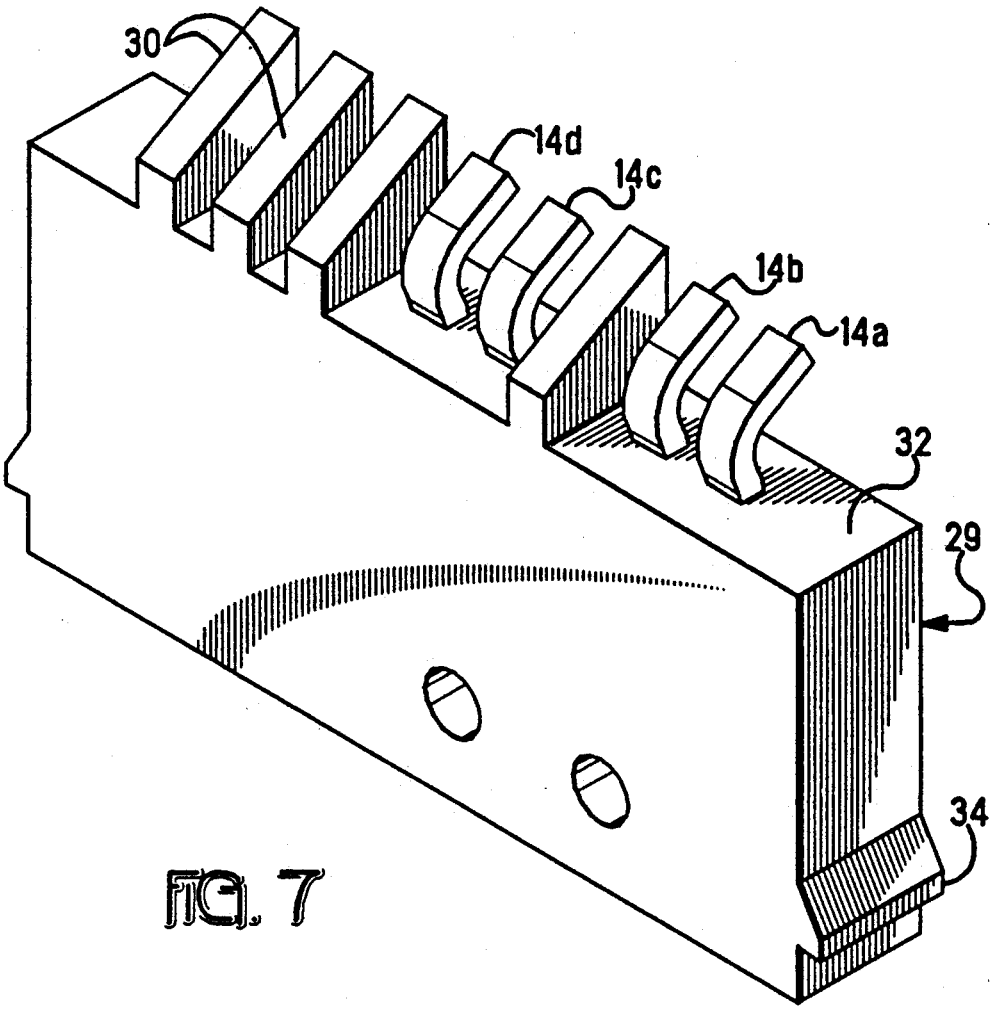
FIG. 7 is perspective view of the shorting bar of FIGS. 5 and 6.

As an optional part of the molding operation, angled plural, ribs 30 may be formed along the contact surface 32, where such ribs occupy non-shorted contact positions laterally spaced from the legs 14. Further, since the modular unit of one embodiment 29 may be bottom loaded into the modular jack housing, a pair of side barbs 34 may be provided so as to latch the unit within a corresponding slot, not shown in the modular jack housing. With the modular unit 29 as molded, the carrier strips 12 are removed and the parallel contact arms formed as illustrated in FIGS. 6 and 7. With this arrangement, the contact legs **14*a* and 14*c* are commoned, while legs 14*b* and 14*d*** are commoned, for example. However, it should be understood that different pairs or contacts may be commoned, as desired, in accordance with this invention.

Figure 8:
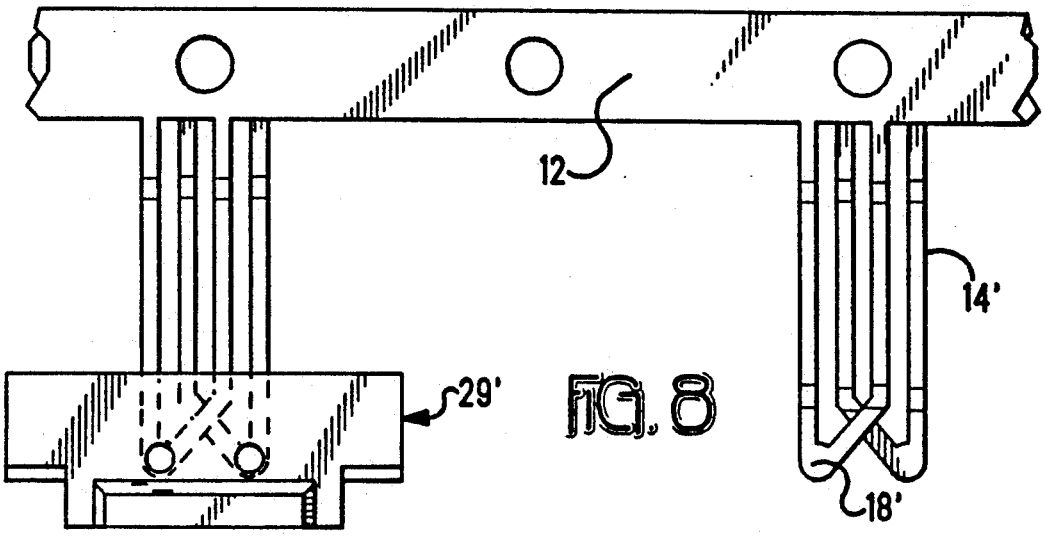
FIG. 8 is a front view similar to FIG. 3, showing an alternate embodiment, further showing an insert molded dielectric body about the closed ends of one set of contacts.
Figure 9:
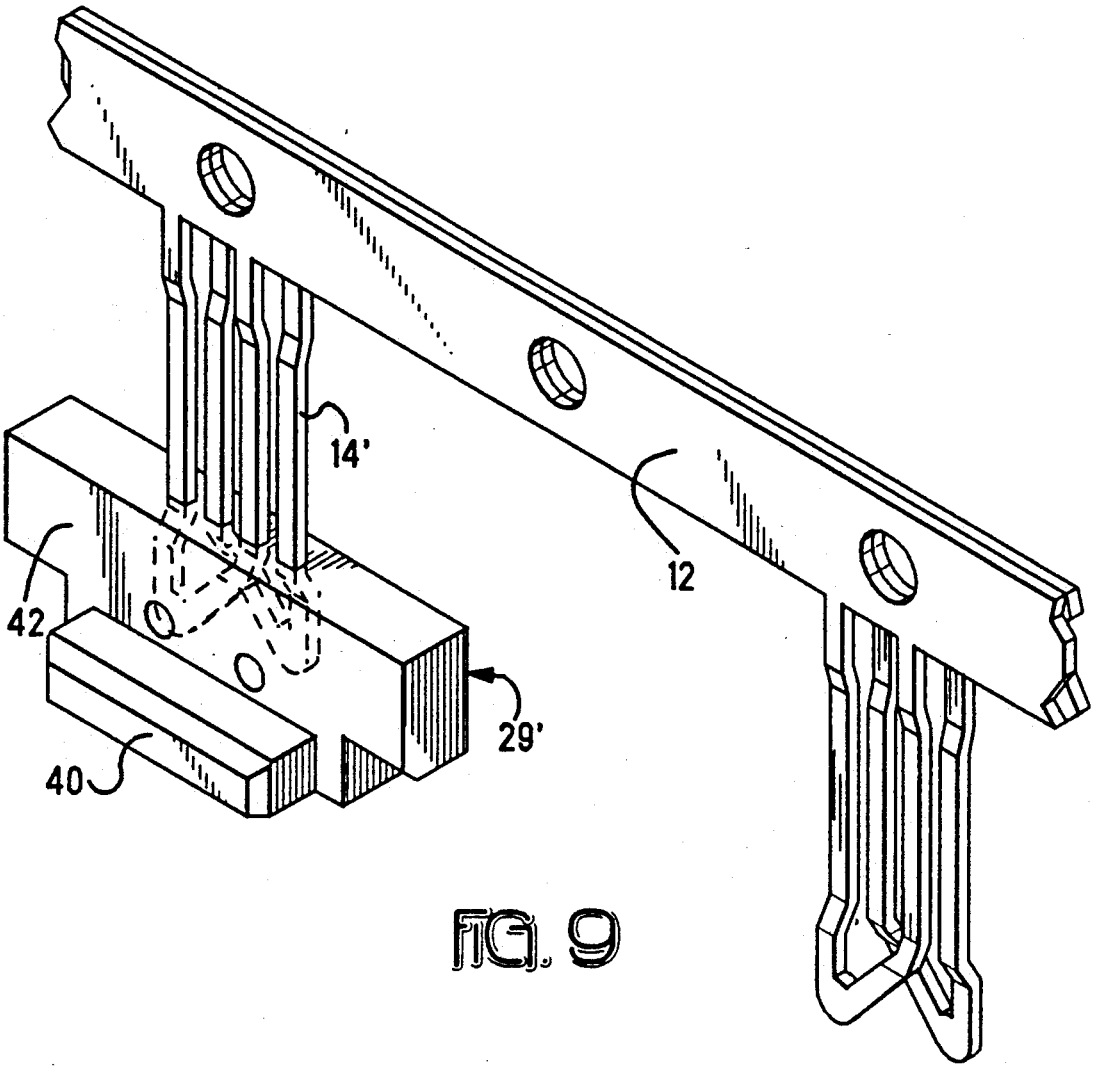
FIG. 9 is a perspective view thereof.

FIGS. 8 and 9 illustrate a modified embodiment for the shorting bar insert of this invention. For instance, one of the legs 14' remains straight while the other arm is angled to meet at the junction 18', representing the flat surface for the molding spacer, as discussed above. Additionally, the modular unit 29' has been modified to include shoulder portion 40, projecting from a side wall 42 thereof. Note also that no ribs are provided to occupy the non-shorted contact positions. While the shorting bar insert of the first embodiment is intended to be bottom loaded into the modular jack assembly, the latter embodiment is intended to be rear loaded. In either case, the shorting bar insert functions in an identical manner.

Figure 10:
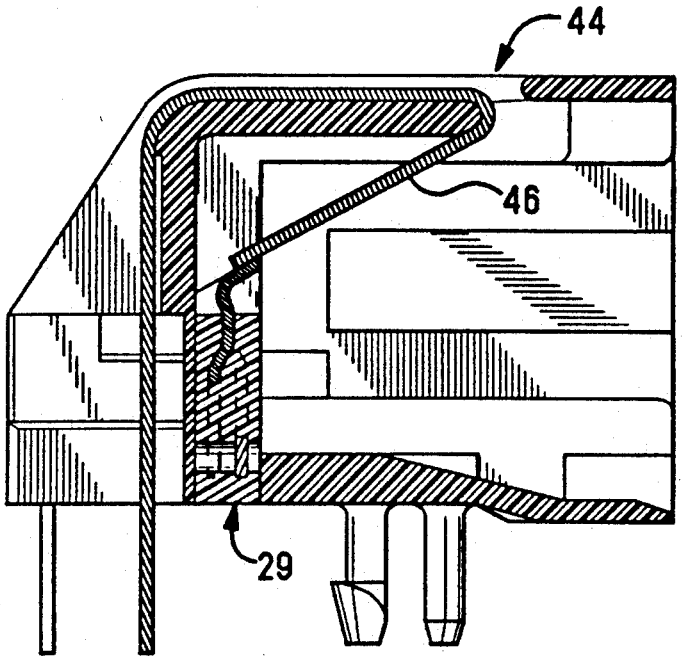
FIG. 10 is a simplified sectional view of a modular jack housing into which the shorting bar of FIG. 5 has been placed.

Finally, FIG. 10 is a sectional view of a modular jack assembly 44, illustrating the cantilevered contact arms 46, mounted therewithin as known in the art, and the modular unit 29 positioned to provide selective shorting of contacts.

I claim:

1. A method of manufacturing a shorting bar insert for placement in a modular jack assembly to provide for the selective shorting of predetermined contacts during periods of nonelectrical engagement with a modular plug, the method comprising the steps of (a) preparing a strip of stamped and formed contacts from a planar sheet metal blank joined together by a removable carrier strip having a front face and a back face, where said contacts are formed in pairs in parallel relationship and joined together at their ends remote from said carrier strip, said carrier strip including registration means offset from the centerline of each respective pair of contacts in a specified asymmetrical relationship, (b) placing a pair of contact containing carrier strips in back-to-back relationship with said registration means aligned, whereby said contacts on the strips realign in overlapping relationship to form a symmetrical set, (c) insert molding a dielectric material about the joined ends of said overlapping sets of contacts, and (d) removing said carrier strips to reveal a modular jack assembly insert having projecting parallel contacts matching the modular jack contact slot spacing.

2. The method according to claim 1, wherein said stamped contacts are angularly formed toward said rear face adjacent said carrier strip and at the remote end toward said front face.

3. The method according to claim 1, wherein a mid portion of each said contact is plated with an electrically conductive metal.

4. The method according to claim 1, wherein said modular jack assembly includes a plurality of cantilevered contact arms and said shorting bar insert is intended to provide shorting between only the selected pairs of said contact arms, and said insert molding further provides for the addition of an angled rib to be aligned with each non shorting contact arm.

5. The method according to claim 1, wherein said modular jack assembly is an 8 position miniature modular jack, and that said insert is intended to provide shorting between contacts 1 & 4 and 2 & 5.

* * * * *